US005183275A

United States Patent [19]

Hoskin

[11] Patent Number: 5,183,275

[45] Date of Patent: Feb. 2, 1993

[54] BRAKE FOR IN-LINE ROLLER SKATE

[76] Inventor: Robert F. Hoskin, 3851 Angora Pl., Duluth, Ga. 30136

[21] Appl. No.: 828,352

[22] Filed: Jan. 30, 1992

[51] Int. Cl.[5] ..... A63C 17/14

[52] U.S. Cl. ..... 280/11.2; 188/5; 188/25

[58] Field of Search ..... 188/5, 25, 74, 80; 280/11.19, 11.2, 11.21, 11.22, 11.25

[56] References Cited

U.S. PATENT DOCUMENTS

| | | | |
|---|---|---|---|
| 218,035 | 7/1879 | Lash | 280/11.2 |
| 508,832 | 11/1893 | Odell | 188/25 |
| 540,637 | 6/1895 | Cole | 188/25 |
| 559,294 | 4/1896 | Lambert | 188/25 |
| 616,429 | 12/1898 | Sparks | 188/25 |
| 650,228 | 5/1900 | Cattaneo | 188/25 |
| 920,848 | 5/1909 | Eubank, Jr. | 280/11.2 X |
| 968,427 | 8/1910 | Simon | 280/11.2 |
| 2,027,487 | 1/1936 | Means | 280/11.2 |
| 2,872,201 | 2/1959 | Wagers | 280/11.2 |
| 3,224,785 | 12/1965 | Stevenson | 280/11.28 |
| 4,298,209 | 11/1981 | Peters | 280/11.2 |
| 4,312,514 | 1/1982 | Horowitz et al. | 280/11.2 |
| 4,807,893 | 2/1989 | Huang | 280/11.2 |
| 5,028,058 | 7/1991 | Olson | 280/11.2 X |
| 5,088,748 | 2/1992 | Koselka et al. | 280/11.2 |

*Primary Examiner*—Charles A. Marmor
*Assistant Examiner*—Michael Mar
*Attorney, Agent, or Firm*—B. J. Powell

[57] ABSTRACT

A brake for in-line roller skates with an articulated mounting on the roller skate frame that movably mounts a roller for selective engagement with rear roller skate wheel on the skate and a ground engaging brake pad arrangement the serves to actuate mounting to move the roller into contact with the roller skate wheel and apply a braking force to the skate wheel and the skate itself.

10 Claims, 11 Drawing Sheets

BRAKE FOR IN-LINE ROLLER SKATE

BACKGROUND OF THE INVENTION

This invention relates generally to braking systems and more particularly to braking systems for in-line roller skates.

In-line roller skates employ at least two wheels positioned to rotate within a common, vertical plane. In-line roller skates are operated in a manner similar to that employed to operate ice skates, requiring substantially the same bodily movements to initiate and sustain forward motion. In-line roller skates are suitable for use in designated roller skating facilities and for on-street operation. This type of skate has become increasingly popular for fitness, recreational, and competitive skating. U.S. Pat. No. 5,028,058 (1990) to B. J. Olson typifies the characteristics of currently available in-line roller skates.

Currently available in-line roller skates enable skaters to achieve high skating speeds, particularly when skating outdoors on hilly terrain. In-line roller skate brakes which develop substantial braking forces are required for safe operation under such conditions. Currently available brakes are not adequate for all potentially-safe skating conditions, and can limit the skater to operation on level or semi-level surfaces.

Currently available in-line roller skates typically employ a brake assembly which is rigidly attached to or integral with the rear of the skate behind the skate rear wheel. The skater applies the brake by extending the skate slightly forward and lifting the forward end of the skate pivotally about the rear wheel. This brings a ground-engaging rubber brake pad into contact with the skating surface, and the resulting friction force slows or stops the forward motion of the skater. U.S. Pat. No. 5,028,058 also typifies the characteristics of this type of brake on currently available in-line roller skates. U.S. Pat. Nos. 4,298,209 to J. Peters (1981) and 2,872,201 to B. T. Wagers (1955) show this type of brake employed on tandem roller skates. Currently available in-line roller skate brakes such as the brake by Olson have several shortcomings:

a) The stopping force which the skater can generate is limited in magnitude. Persons of average skating ability can generally skate safely only on level or semi-level surfaces due to braking limitations.
b) The brake pad exhibits excessive wear when operated on asphalt, sidewalk-finished concrete, or other abrasive, non-slip surfaces. The majority of outdoor skating surfaces are of this type. As a result, frequent outdoor skating generally leads to frequent brake pad replacement.
c) Slightly irregular or mildly bumpy surfaces are often encountered in outdoor skating. Upon initial brake application on these types of surfaces the brake pad often skips or vibrates on the skating surface. The rigid nature of the brake mounting to the skate transfers these braking induced vibrations directly to the skate. This makes brake application difficult.

Another type of roller skate brake which can provide large-magnitude stopping forces is typified by U.S. Pat. Nos. 4,807,893 to C. H. Huang (1989); 2,027,487 to W. H. Means (1936); and 218,035 to J. S. Lash (1879). These brakes are shown implemented on tandem roller skates. A brake pad or roller is located behind the rear wheels of the skate, and is attached to the skate by a lever arrangement. The skater applies the brake by extending the skate slightly forward and lifting the forward end of the skate pivotally about the rear wheel. This brings the brake pad or roller into contact with the skating surface, and actuates one end of the lever arrangement. A second brake pad on the opposite end of the lever arrangement is pressed into contact with the rear skate wheels. This slows wheel rotation, thereby slowing the forward motion of the skater. These brakes can produce large-magnitude braking forces, but have a severe shortcoming when considered for application on current in-line roller skates because current in-line roller skates employ wheels made of resilient, rubber-like materials. Wheels of this type will wear excessively if pressed into sliding contact with a brake pad as discussed above. These wheels are also relatively expensive. Brake-induced wear on the skate wheels will result in expensive, premature wheel replacement.

A second type of prior-art roller skate brake employs a roller or rollers which press into the skate wheels upon brake application. The rolling resistance created between the wheel and roller slows wheel rotation, thereby slowing the forward motion of the skater. Examples of this type of brake are shown in U.S. Pat. Nos. 4,312,514 to I. Horowitz (1982); 3,224,785 to G. W. Stevenson (1965); and 920,848 to R. B. Eubank (1909). The brakes in these patents have not enjoyed widespread use, however.

The roller-brake in U.S. Pat. No. 4,312,514 is not suitable for intermittent braking purposes. This brake develops braking forces in a continuous manner, and is intended to be a speed-limiting device for beginning skaters. The braking force is safely adjusted only when the skater is completely stopped.

The roller-brake embodiments in U.S. Pat. No. 3,224,785 are either too complex to be practical, or would induce excessive wear on the rear skate wheel if employed on current in-line roller skates. Brake operation produces roller-wheel slippage, and this would cause excessive wear on the rear wheel.

The roller-brake in U.S. Pat. No. 920,848 is arranged in an awkward manner for current skating practices. Normal forward-propelling bodily movements could easily lead to unintentional brake application, particularly when skating uphill.

The brakes U.S. Pat. Nos. 4,312,514 and 920,848 depend upon rolling resistance generated by contact between the skate rear wheels and associated rollers to generate braking forces. Roller-wheel rolling resistance will produce braking forces adequate for in-line roller skates only if excessive normal forces between the wheel and roller are developed. Such large forces tend to be damaging to the skate wheel and other parts of the skate.

Other relevant prior-art for roller-brakes appears in U.S. Pat. Nos. 650,228 to G. Cattaneo (1900); 616,429 to W. H. Sparks (1898); 559,294 to L. C. Lambert (1896); 540,637 to F. J. Cole (1895); and 508,832 to S. E. Odell (1893). The brakes in these patents are designed for wagons and bicycles and are not practical for in-line roller skates.

SUMMARY OF THE INVENTION

These and other problems and disadvantages associated with the prior art are overcome by the invention disclosed herein by providing a brake mechanism for in-line roller skates which is capable of applying large magnitude braking forces to the roller skates without excessive wear to the brake pad and/or the skate wheels, which distributes the braking forces over an enlarged surface area to reduce the wear rate thereof, and which isolates any sliding friction used in the braking process from the skate wheels so as to prevent excessive wear thereto. The invention also reduces the vibrations transmitted to the wearer through the skates, permits greater control over the application of the braking forces by the user, and varies the contact force between the roller skate wheel and the brake proportional to the magnitude braking forces being generated to provide improved safety of operation.

Accordingly, one object of the present invention is to provide a brake assembly which develops substantially greater braking forces than currently available in-line roller skate brakes. This will provide improved safety through shorter stopping distances. This will also enhance skate operability by providing the ability to brake safely on a wider variety of sloped skating surfaces.

Another object of the invention is to provide a brake assembly which requires less frequent brake pad replacement. Yet another object of the invention is to provide a brake assembly which inhibits the transfer of braking induced vibrations to the skate upon which the brake assembly is employed. This will make the brake more comfortable and safer to operate. Still another object of the invention is to provide a brake assembly which is operated using the same braking technique as employed for currently available brakes.

The apparatus of the invention includes an articulated mounting mounted on an in-line roller skate; a roller rotatably mounted on the mounting and adapted to selectively engage the periphery of the roller skate wheel; a braking assembly for applying a resistive force to the roller to retard rotation of the roller and also to the roller skate wheel through the roller when the roller is in engagement with the roller skate wheel; and, a ground engaging actuator for selectively moving the roller into contact with the periphery of the roller skate wheel and for causing the braking assembly to apply the resistive force to the roller thereby causing the rotation of the roller to be retarded and thus applying a braking force to the skate wheel in opposition to the rotation thereof. The articulated mounting may be constructed and arranged to cause the roller to engage the roller skate wheel before the braking assembly is applied to the roller. The ground engaging actuator may also be a brake pad to apply an additional braking force to the roller skate. The invention also contemplates the method of operation of the apparatus.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

First Embodiment—FIGS. 1-7

Figure 1:
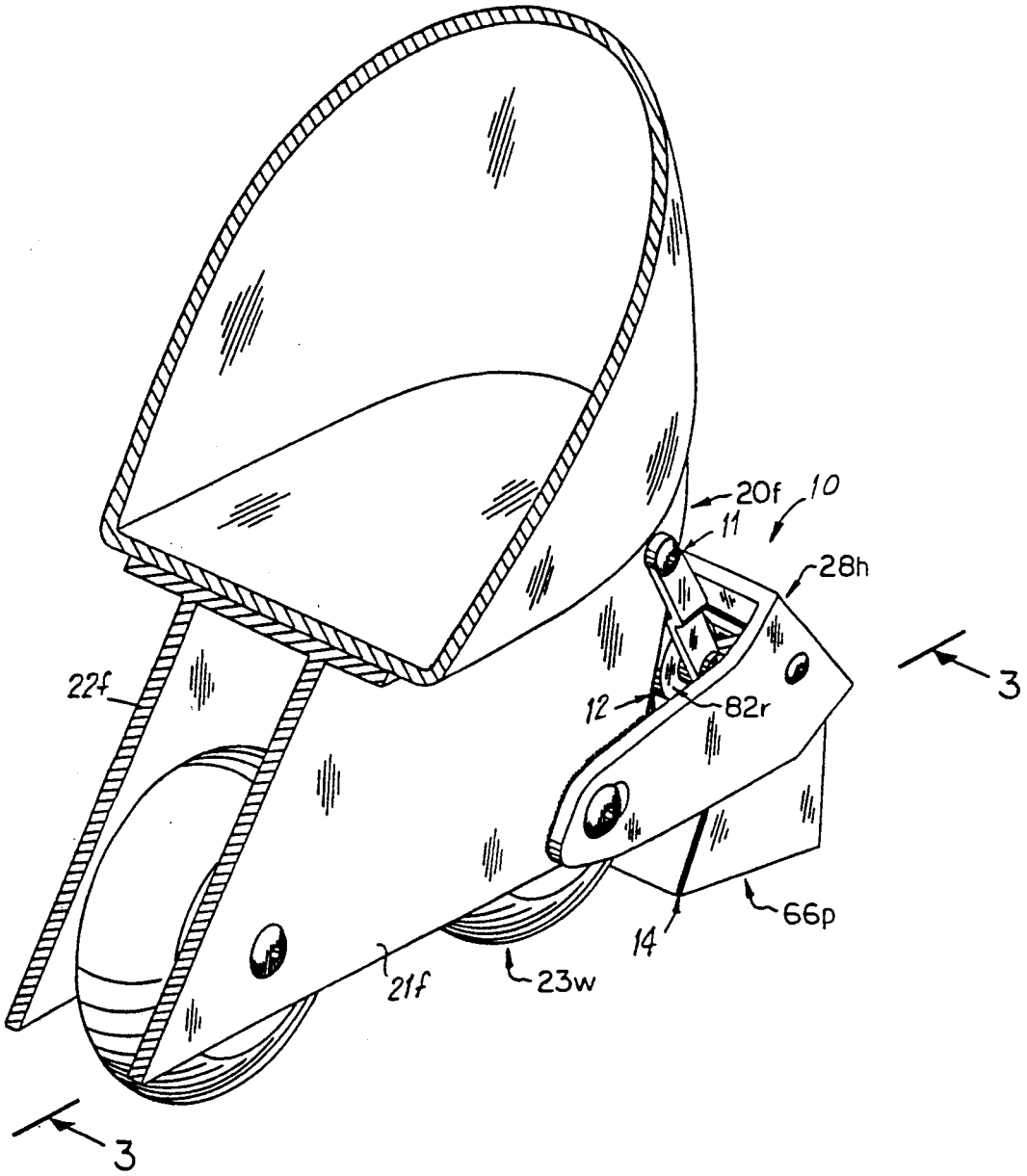
FIG. 1 is a forward perspective view of a first embodiment of the brake assembly invention employed on an in-line roller skate wherein forward and upper portions of the skate are deleted for clarity.
Figure 2:
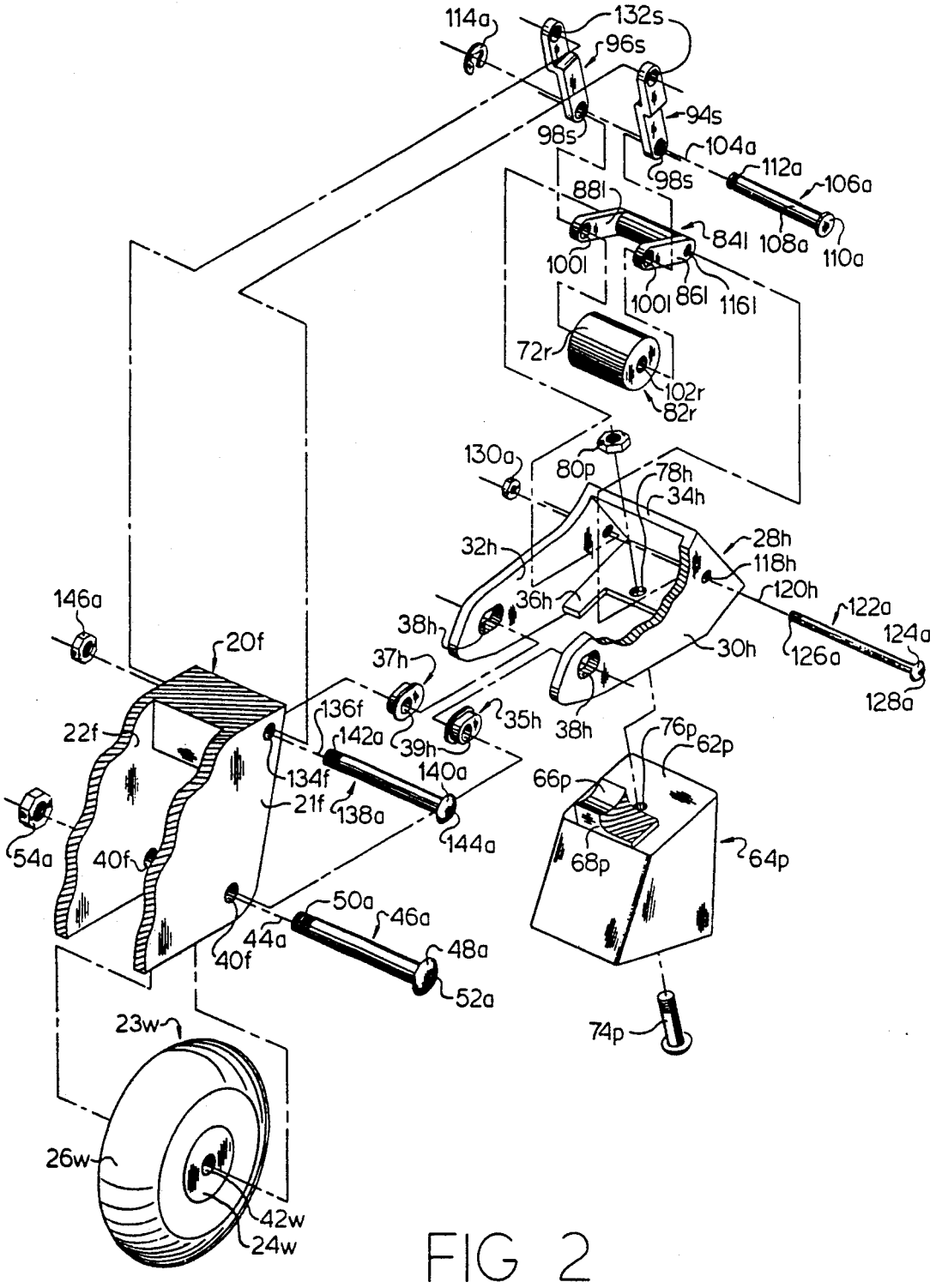
FIG. 2 is an exploded forward perspective view of the in-line roller skate and brake assembly of FIG. 1 wherein forward and upper portions of the skate have been deleted for clarity.

Refer now to FIGS. 1 and 2. A portion of a skate frame **20*f*, and a skate rear wheel 23*w* of a typical in-line roller skate are shown. The skate frame consists of two side rails 21*f* and 22*f* with an intermediate structure. The wheel consists of a central hub containing a bearing 24*w*, and a relatively elastic, resilient tire member 26*w***. The parts described thus far are recognized as typical of those conventionally available on in-line roller skates. The parts described subsequently in this section constitute a first embodiment of the brake invention.

The brake 10 seen in FIGS. 1-7 includes an articulated mounting 11 mounted on the skate frame **20*f*. The mounting 11 rotatably mounts a roller member 12 for movement into and out of engagement with the periphery of the tire member 26*w* on the skate wheel 23*w*. A ground engaging actuator 14 is provided to cause the roller member 12** to be moved into contact with the wheel periphery.

In the first embodiment, the mounting 11 includes a brake housing **28*h* that is positioned at the rear of the skate frame. The brake housing is a one piece structure, and consists of substantially parallel, forwardly extending side arms 30***h* and 32*h* between which cross members 34*h* and 36*h* are arranged. A portion of arm 30*h* is removed for clarity. The side arms overlie the frame side rails 21*f* and 22*f*. Oblong axle plugs 35*h* and 37*h* with offset holes 39*h* are received into side arm apertures 38*h*. The largest dimension of these apertures extends in a substantially horizontal direction. The plugs 35*h* and 37*h* may be inserted in either of two distinct orientations to be described subsequently.

Figure 4:
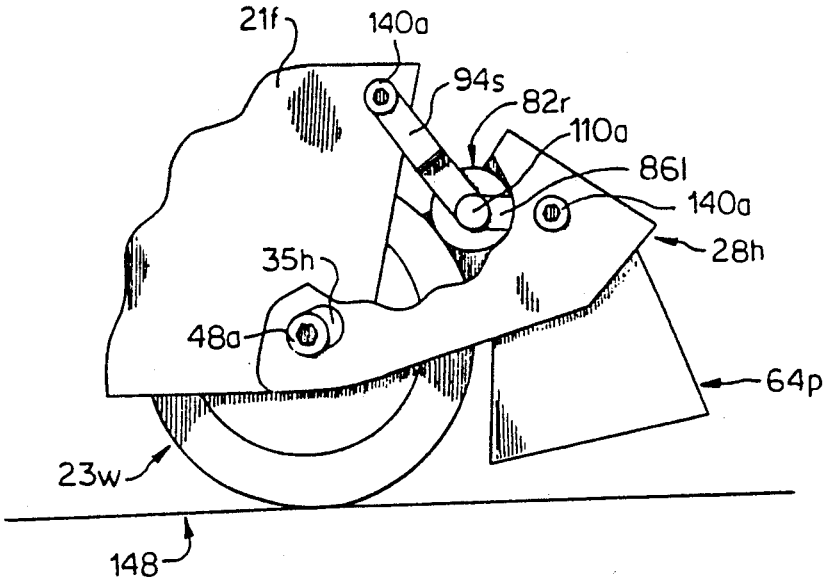
FIG. 4 is a partial side view of the brake assembly of FIG. 1 and shows an oblong axle plug in a first operating position.
Figure 5:
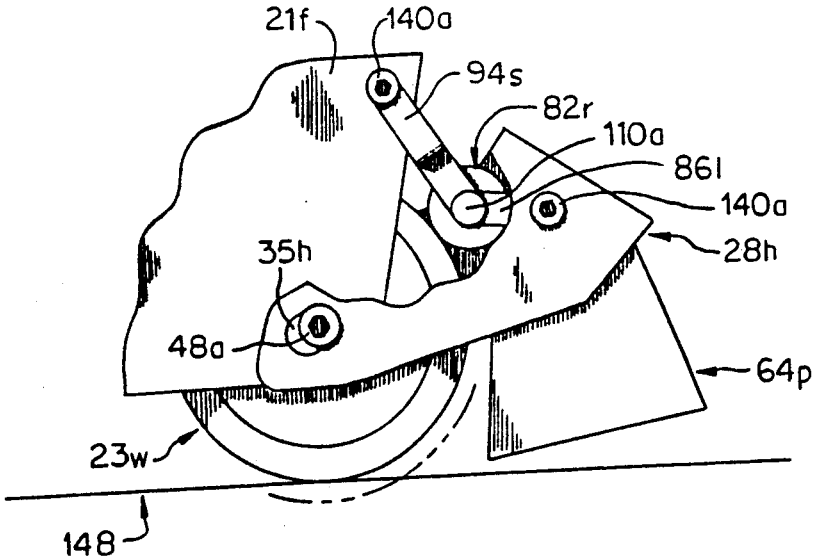
FIG. 5 is a partial side view of the same subject matter as FIG. 4 wherein the plug is in a second operating position.

Referring now to FIGS. 4 and 5, the oblong plugs 35*h* and 37*h* position the brake housing in either of two distinct positions. The first plug orientation locates the wheel axle toward the forward ends of side arm apertures 38*h*, positioning the housing as shown in FIG. 4. The second plug orientation locates the wheel axle toward the rearward ends of apertures 38*h*, positioning the housing in a more forward location as seen in FIG. 5. These axle plug orientations are employed to adjust the brake to compensate for skate wheel wear. This will be discussed in the subsequent section. Note that other types of non-round axle plugs also fall within the purview of the invention.

Figure 3:
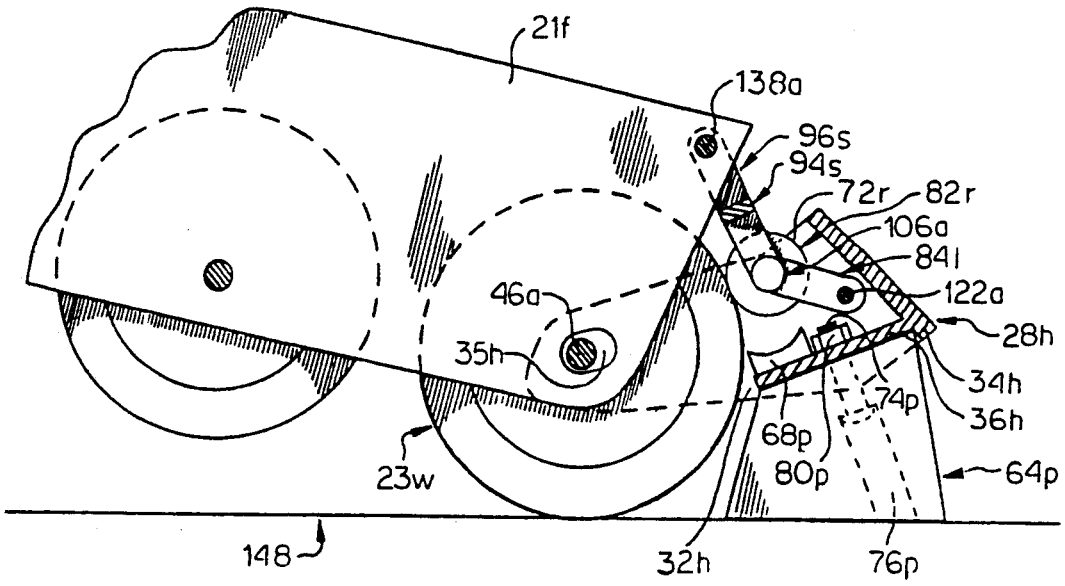
FIG. 3 is a cross-sectional view of the in-line roller skate and brake assembly of FIG. 1 shown in a first operational position and taken in the direction of cutting plane 3—3 of FIG. 1.

Refer now to FIGS. 2 and 3. Holes 39*h* in the oblong plugs, holes 40*f* in the frame side rails, and central-axis hole 42*w* in the wheel bearing are aligned on wheel central-axis 44*a*. A wheel axle 46*a* is formed by a bolt having a wide, smoothly contoured head 48*a* and a threaded end 50*a*. The head is preferably provided with a countersunk allen socket 52*a*. The threaded end of the wheel axle passes through holes 39*h*, 40*f*, and 42*w* along the wheel central-axis. A lock nut 54*a* is threadedly received on the wheel axle. The wheel axle and lock nut together inhibit lateral spreading of the frame side rails and brake housing side arms, but allow the brake housing and skate rear wheel to freely rotate about the wheel axle.

Cross-member 34*h* lies between the side arms near the rear of the brake housing, and inhibits torsional flexing of the housing. Cross-member 36*h* connects the side arms near the bottom of the brake housing and inhibits lateral flexing of the housing. Cross-member 36*h* also forms a downwardly facing housing mounting surface, which confronts and engages pad mounting surface 62*p* of a ground-engaging brake pad 64*p* in the actuator 14.

The brake pad 64*p* of actuator 14 is formed of rubber or a comparable friction-grip material. Brake pad upper friction-surface 66*p* is located on brake pad upper extension 68*p* above the pad mounting surface. A portion of 68*p* is removed for clarity in FIG. 2. Surface 66*p* has a curvature similar to the curvature of substantially smooth roller peripheral surface 72*r* of a roller 82*r* of the roller member 12. A cut-out in lower cross-member 36*h* accommodates brake pad upper extension 68*p*, allowing the brake pad extension to project through and above the forward portion of the cross-member. A bolt 74*p* passes through aperture 76*p* of the brake pad and through aperture 78*h* of cross-member 36*h*. A lock nut 80*p* is threadedly received by bolt 74*p*. The lock nut and bolt together clamp the brake pad to cross-member 36*h*.

Roller 82*r* is positioned at the rear of skate frame 20*f* substantially between brake housing side arms 30*h* and 32*h*, and above brake pad surface 66*p* by a link 84*l* with two forwardly extending lateral arms 86*l* and 88*l*. The link 84*l* is pivoted at one end to the housing 28*h* about an axis 120*h* parallel to the skate wheel rotational axis 44*a* while the roller 82*r* is rotatably mounted between the forward ends of the link arms 86*l* and 88*l*. A pair of struts 94*s* and 96*s* are pivoted at their forward upper ends to the rear of skate frame 20*f* at locations above and laterally disposed to the link arms about a pivot axis parallel to the skate wheel axis 44*a*. The lower rear ends of the struts 94*s* and 96*s* partially overlie the projecting ends of the link arms 86*l* and 88*l*. Holes 98*s* in the lower rear ends of the struts 94*s* and 96*s*, holes 100*l* in the link arms, and central-axis hole 102*r* in the roller are aligned on roller axle central-axis 104*a*. A roller axle 106*a* is formed by a shaft 108*a* with a wide, substantially flat head 110*a* and an annular groove 112*a*. The grooved end of the roller axle passes through holes 98*s*, 100*l*, and 102*r* along the roller axle central-axis. A roller axle clip 114*a* snaps into the annular groove. The roller axle and clip together inhibit the struts, link and roller from laterally translating relative to each other, but allow the struts, link and roller to freely rotate about the roller axle.

A rear hole 116*l* in link 84*l* is aligned with holes 118*h* in the brake housing on axis 120*h*. A brake housing-link shaft 122*a* is formed by a bolt having a wide, smoothly contoured head 124*a* and a threaded end 126*a*. The head is preferably provided with a countersunk allen socket 128*a*. Shaft 122*a* passes through holes 118*h* and 116*l* along axis 120*h*. A lock nut 130*a* is threadedly received on bolt end 126*a*. The shaft 122*a* and lock nut 130*a* together rotatably mount the link to the brake housing.

Upper holes 132*s* in struts 94*s* and 96*s* are aligned with hole 134*f* in the rear of the skate frame on axis 136*f*. A strut-skate frame shaft 138*a* is formed by a bolt having a wide, smoothly contoured head 140*a* and a threaded end 142*a*. The head is preferably provided with a countersunk allen socket 144*a*. Shaft 138*a* passes through holes 132*s* and 134*f* along axis 136*f*. A lock nut 146*a* is threadedly received on bolt end 142*a*. The shaft and lock nut together rotatably mount the struts to the skate frame. The following parts assembled as described above form an articulated brake frame with an integral axle: brake housing 28*h*, link 84*l*, shaft 122*a*, lock nut 130*a*, struts 94*s* and 96*s*, roller axle 106*a*, and clip 114*a*. An actuation assembly is formed by the articulated brake frame, brake pad 64*p*, bolt 74*p*, and lock nut 80*p*.

Figure 6:
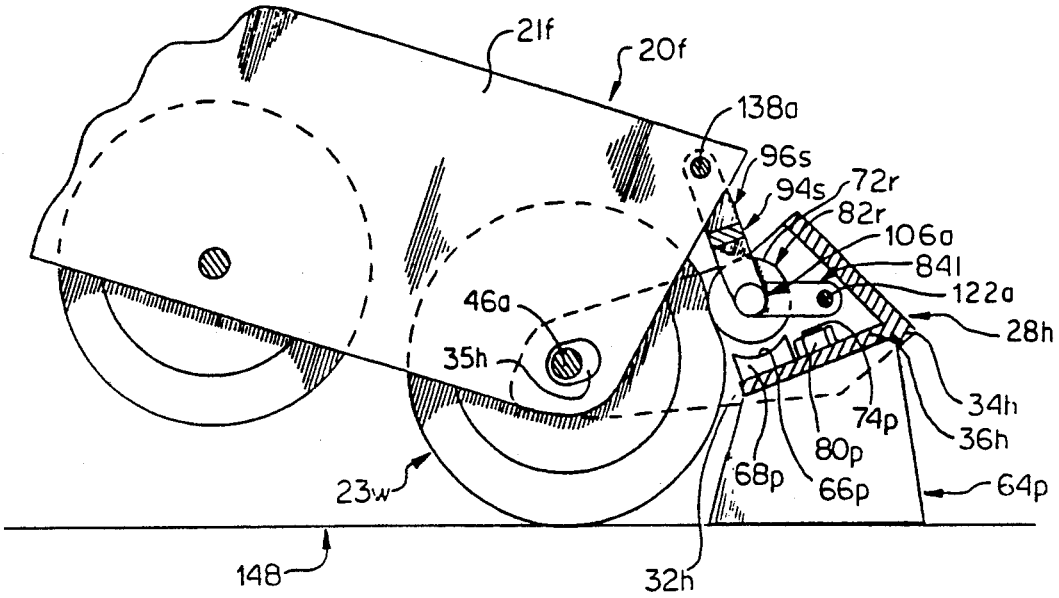
FIG. 6 is a cross-sectional view of the same subject matter as FIG. 3 wherein the in-line roller skate and brake assembly are in a second operating position.
Figure 7:
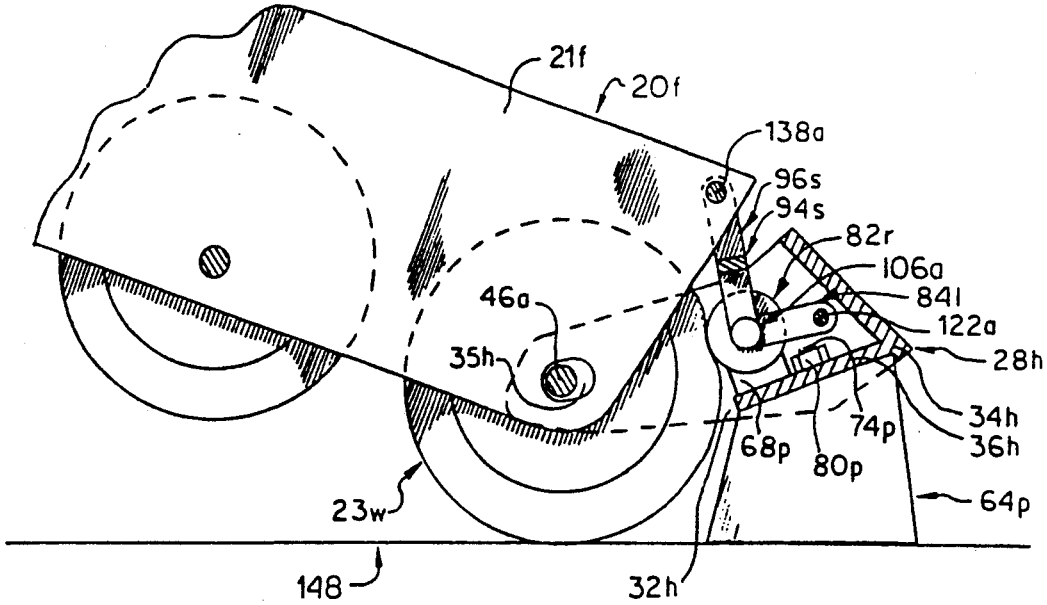
FIG. 7 is a cross-sectional view of the same subject matter as FIG. 3 wherein the in-line roller skate and brake assembly are in a third operating position.

Operation of First Embodiment—FIGS. 3, 6, and 7

Refer now to FIG. 3. Assume that the in-line skate brake is employed upon at least one skate of a pair of in-line skates. Further assume that the skates are being operated in a forward facing direction on a skating surface 148 at some velocity. To operate the brake, the skate is extended slightly forward of the skater, and the forward end of the skate is raised pivotally about the rear wheel. This action causes all skate wheels except rear wheel 23*w* on the forwardly extended skate to lose contact with the skating surface, and brings brake pad 64*p* into contact with the skating surface. This action is identical to the braking technique employed for in-line skates with currently available brakes.

Refer now to FIG. 6. Brake application causes an upward actuating force to be exerted on brake pad 64*p*, which rotates or pivots brake housing 28*h* counter-clockwise relative to skate frame 20*f* about wheel axle 46*a*. This rotates link 84*l* counter-clockwise relative to the brake housing about shaft 122*a*, and rotates struts 94*s* and 96*s* clockwise relative to the skate frame about shaft 138*a*. These brake housing, link, and strut relative rotations displace the roller axle 106*a* and roller 82*r* forward relative to the skate frame and skate rear wheel 23*w*. This forward displacement brings roller peripheral surface 72*r* into contact with tire member 26*w*. The resilient nature of the tire member causes it to act as a spring, providing progressive resistance to roller displacement, brake housing rotation, and brake application. The tire member compliance causes it to conform to the roller pheripheral surface over the area of contact. This establishes substantially non-slipping, rolling contact between the tire member and roller peripheral surface.

Referring now to FIG. 7, additional rearward skate tilting further displaces the roller into the tire member, and brings brake pad upper-friction surface 66*p* into contact with the roller peripheral surface. Frictional contact between surface 66*p* and the roller peripheral surface inhibits roller rotation, thereby inhibiting rotation of skate rear wheel 23*w*. The forward velocity of the skater is reduced by the braking forces resulting from frictional contact between the brake pad and skating surface, and by the motion-opposing torque induced on the rear wheel by the brake pad-roller frictional force.

The resilient nature of the tire member tends to displace the roller rearwardly and rotate the brake housing clockwise relative to the skate. This causes the brake to be disengaged when the skate is tilted forward to its original, non-braking orientation. In the non-braking position the weight of the brake pad tends to rotate the brake housing clockwise. This tends to move the roller rearward, providing a small clearance between the roller peripheral surface and the tire member. This small clearance ensures that the brake will not interfere with non-braking skate operation.

Refer now to FIGS. 4 and 5. Normal skating induces wear on the skate wheels, and reduces the diameter of all the wheels. More importantly, this wear reduces the diameter of the rear skate wheel. This is illustrated in FIG. 5 where the unworn wheel perimeter is shown in phantom lines. This reduced wheel diameter increases the clearance between the roller peripheral surface and the tire member during non-braking skate operation. Upon brake application, the roller displacement into the tire member is smaller than for a less worn wheel. This decreases the roller-tire member normal force during braking, increasing the possibility for roller-tire member slippage when the roller peripheral surface contacts brake pad surface 66*p*.

Axle plugs 35*h* and 37*h* compensate for the above described wheel wear by repositioning the brake housing. For relatively unworn wheels the plug orientation in FIG. 4 suffices. As the wheels wear, and roller-tire member slippage during braking is imminent, the axle plugs are oriented as shown in FIG. 5. This repositions the brake to the more forward position, reducing the clearance between the roller peripheral surface and tire member. Brake operating characteristics are thus restored.

Figure 8:
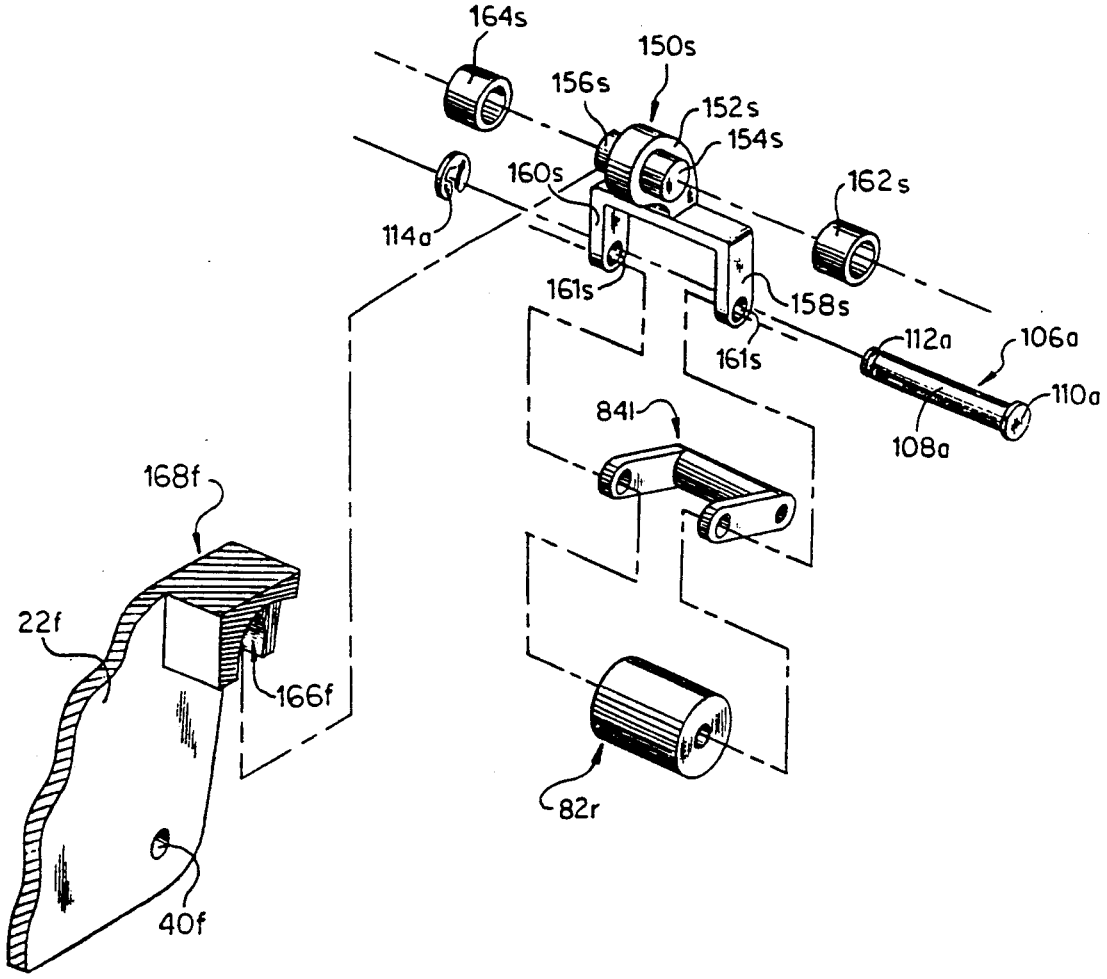
FIG. 8 is an exploded forward perspective view of a second embodiment of the invention wherein a one-piece strut, bushings, and a mounting socket are included in the view.
Figure 9:
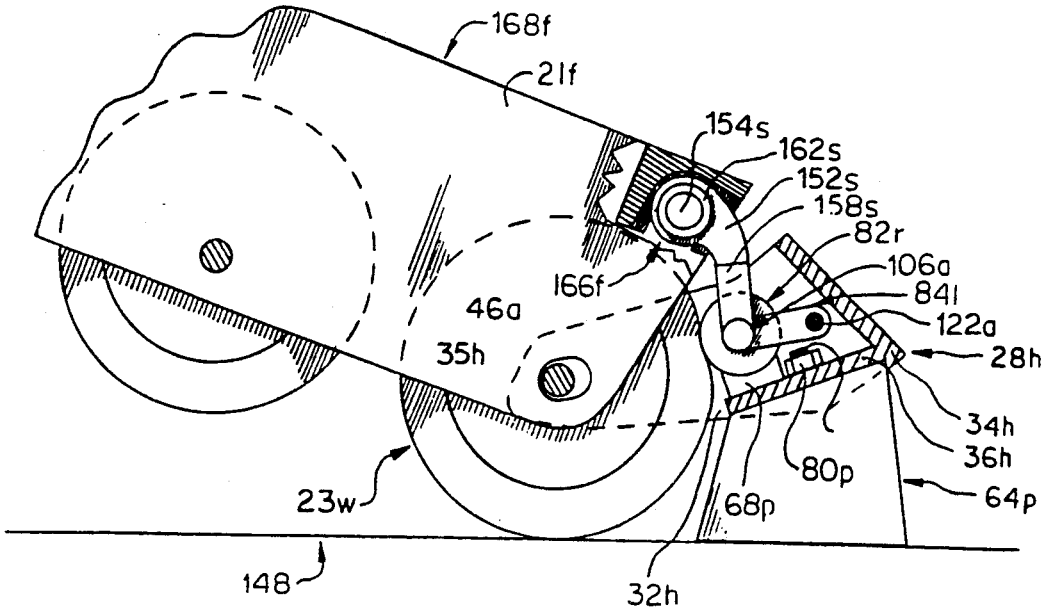
FIG. 9 is a cross-sectional view of the in-line roller skate of FIG. 1 and the second embodiment of the brake assembly invention shown in an operational position equivalent to the operational position of FIG. 7.

Description of Second Embodiment—FIGS. 8 and 9

A second embodiment of the invention is identical to the first embodiment except as subsequently described.

Compare FIGS. 8 and 9 with FIGS. 2 and 7. For clarity, FIG. 8 shows a limited number of parts, primarily parts which are unique to the second embodiment. In the second embodiment of the invention, a one-piece strut 150*s* replaces struts 94*s* and 96*s*. This one-piece strut consists of an upper section 152*s* with cylindrical lateral extensions 154*s* and 156*s*, and two downwardly extending arms 158*s* and 160*s*. Holes 161*s* are located in the lower ends of arms 158*s* and 160*s*. Bushings 162*s* and 164*s* are formed of a compliant, friction-grip material such as rubber, and are friction fit onto cylindrical extensions 154*s* and 156*s*. The bushings ans strut cylindrical extensions are friction fit into a rear socket 166*f* at the rear of skate frame 168*f*. Sections of 168*f* are removed for clarity. Strut arms 158*s* and 160*s* engage roller 82*r*, link 84*l*, roller axle 106*a*, and roller axle clip 114*a* in the manner of the first embodiment. Strut 150*s* becomes part of the articulated brake frame for the second embodiment.

Operation of Second Embodiment—FIG. 9

Operation of the second embodiment is identical to operation of the first embodiment except as subsequently described.

Compare FIG. 9 with FIG. 7. In the first embodiment, struts 94*s* and 96*s* are rotatably attached to skate frame 20*f* by shaft 138*a* and lock nut 146*a*. In the second embodiment, this rotatable attachment is provided by strut cylindrical extensions 154*s* and 156*s*, bushings 162*s* and 164*s* and skate frame socket 166*f*. The bushing compliance allows small strut rotations within the socket which are required for brake operation in the manner of the first embodiment. The bushing compliance also inhibits downward slippage of the strut from the socket, thus retaining the strut in the socket during non-braking skate operation.

Figure 10:
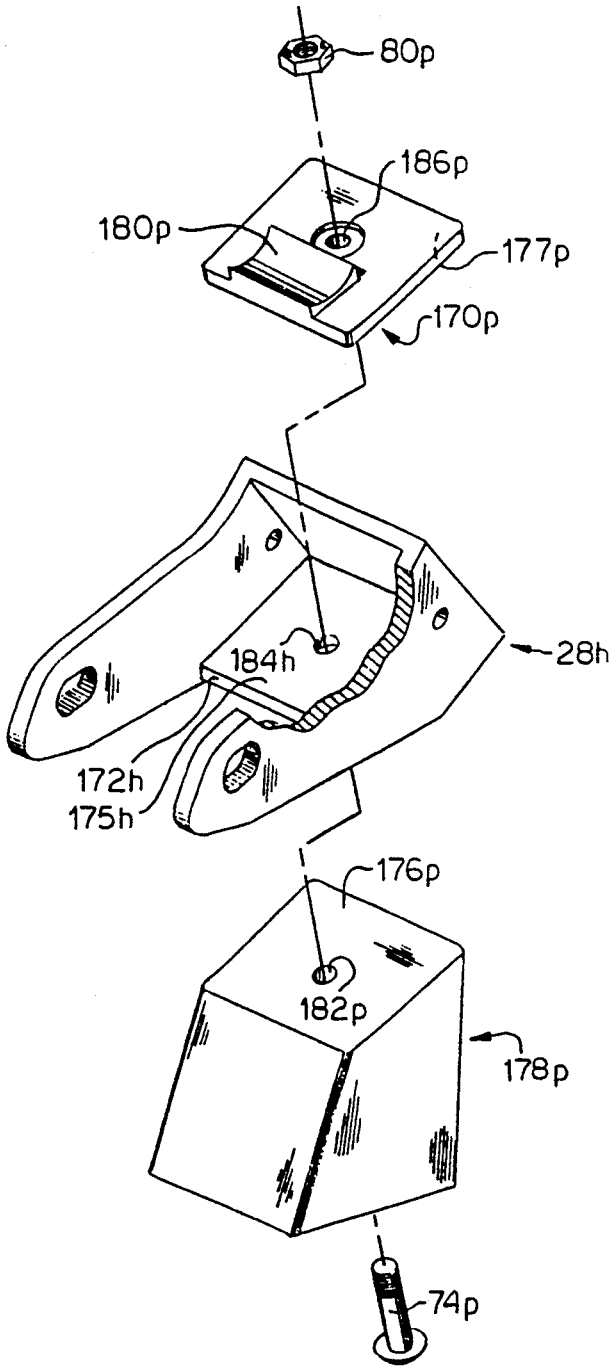
FIG. 10 is an exploded forward perspective view of a third embodiment of the invention wherein a brake housing, brake pad, and secondary brake pad are included in the view.
Figure 11:
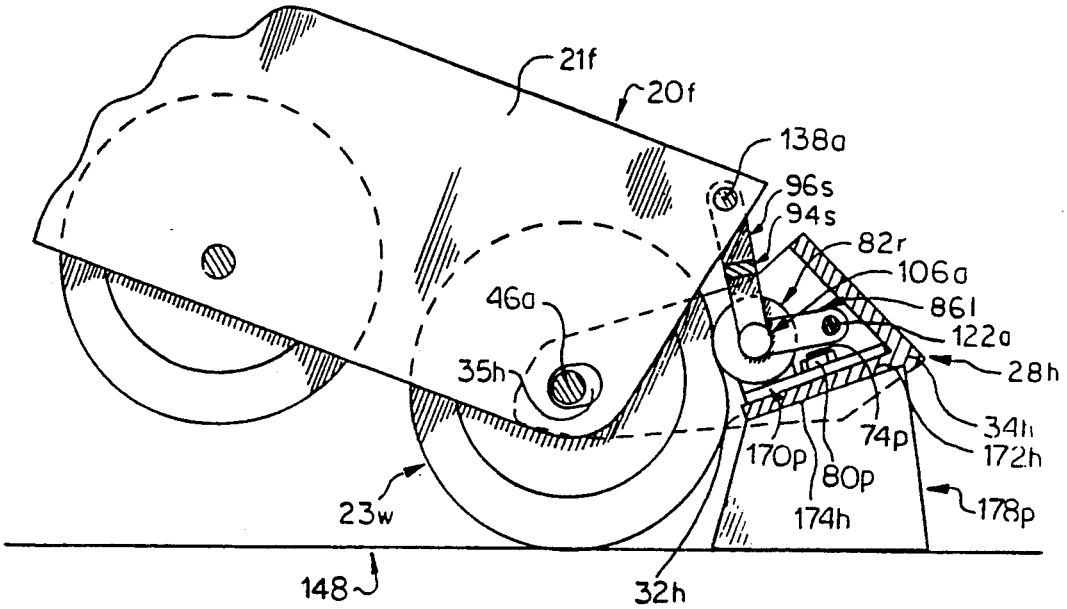
FIG. 11 is a cross-sectional view of the in-line roller skate of FIG. 1 and the third embodiment of the brake assembly invention shown in an operational position equivalent to the operational position of FIG. 7.

Description of Third Embodiment—FIGS. 10 and 11

A third embodiment of the invention is identical to the first embodiment except as subsequently described.

Compare FIGS. 10 and 11 with FIGS. 2 and 7. For clarity, FIG. 10 shows a limited number of parts, primarily parts which are unique to the third embodiment. In the third embodiment of the invention, secondary brake pad 170*p* replaces upper extension 68*p* of brake pad 64*p* of the first embodiment. Cross-member 172*h* connects brake housing side arms 30*h* and 32*h* near the bottom of the brake housing, and inhibits lateral flexing of the housing. Cross-member 172*h* forms a downwardly facing housing mounting surface, which confronts and engages mounting surface 176*p* of a primary brake pad 178*p*. Note that the forward portion of cross-member 172*h* does not contain a cut-out as in cross-member 36*h* of the first embodiment. The primary brake pad is formed of rubber or a comparable friction-grip material. Cross-member 172*h* also forms an upwardly facing housing mounting surface 175*h*, which confronts and engages pad mounting surface 177*p* of secondary brake pad 170*p*. The secondary brake pad is formed of rubber, a comparable friction-grip material, or a conventional brake material.

Secondary brake pad friction-surface 180*p* has a curvature substantially similar to the curvature of roller peripheral surface 72*r*. Bolt 74*p* passes through aperture 182*p* of the primary brake pad, through aperture 184*h* of cross-member 172*h*, and through aperture 186*p* of the secondary brake pad. Nut 80*p* is threadedly received by bolt 74*p*. The lock nut and bolt together clamp primary brake pad 178*p* to cross-member 172*h*, and secondary brake pad 170*p* to cross-member 172*h*.

Operation of Third Embodiment—FIG. 11

Operation of the third embodiment is identical to operation of the first embodiment except as subsequently described.

Refer now to FIG. 11. In the third embodiment of the invention roller peripheral surface 72*r* contacts secondary brake pad friction-surface 180*p* upon brake application in the manner of the previous embodiments. Friction between surfaces 72*r* and 180*p* inhibits roller rotation, thereby inhibiting rotation of skate rear wheel 23*w*. The forward velocity of the skater is reduced by the braking forces resulting from frictional contact between brake pad 178*p* and skating surface 148, and by the motion-opposing torque induced on the rear wheel by the secondary brake pad-roller frictional force.

Figure 12:
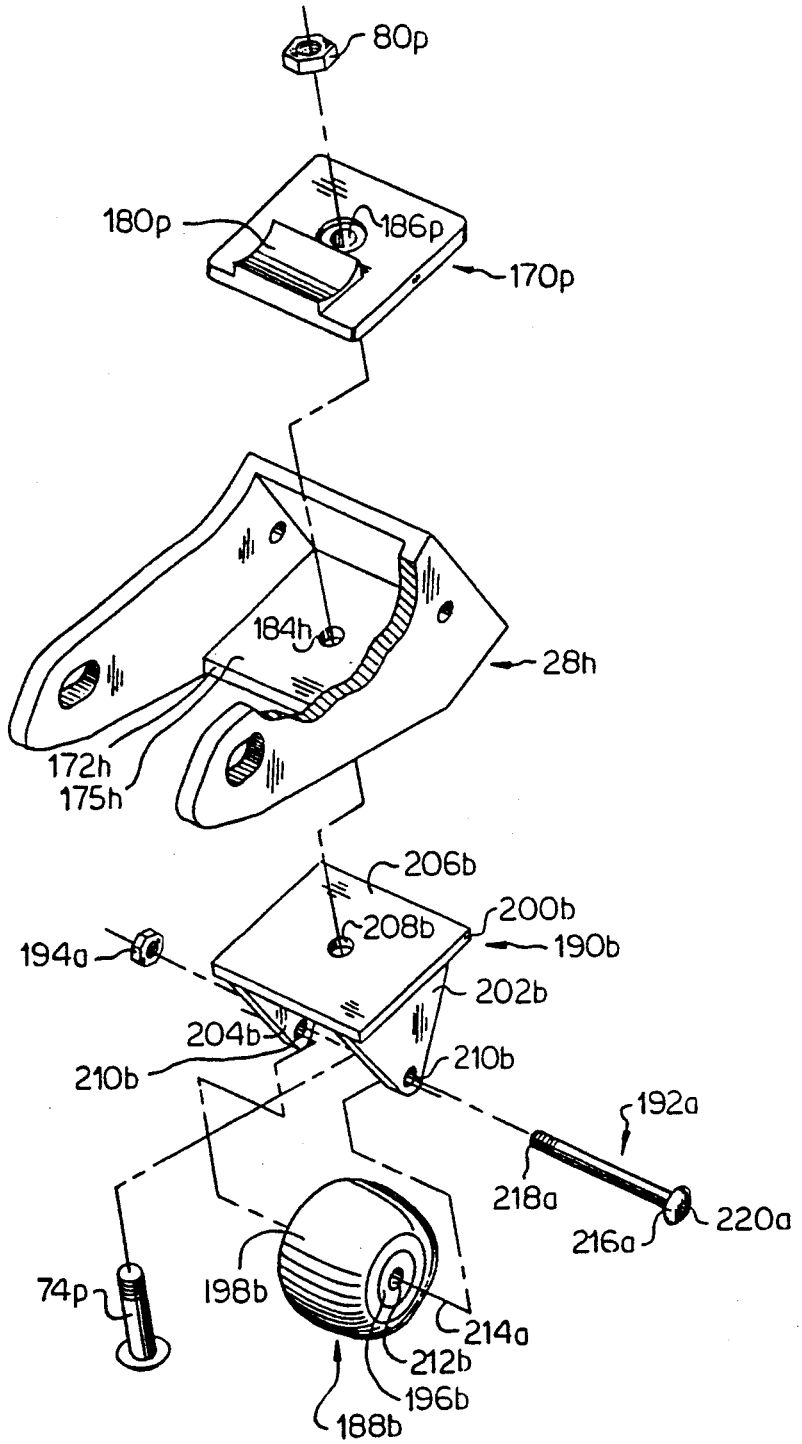
FIG. 12 is an exploded forward perspective view of a fourth embodiment of the invention wherein a brake housing, brake wheel, brake wheel bracket, and secondary brake pad are included in the view.
Figure 13:
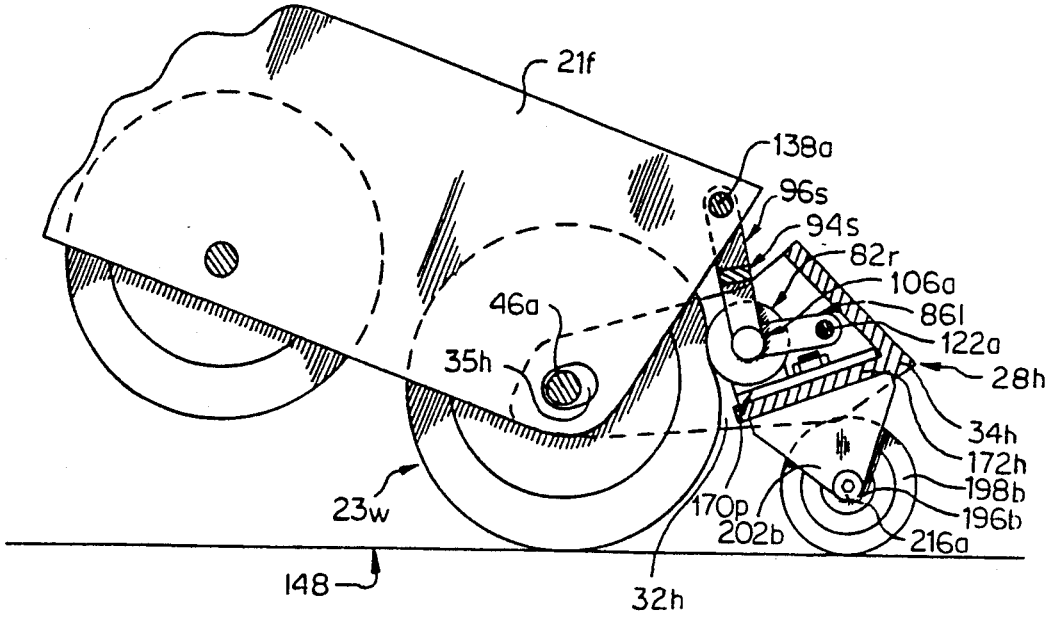
FIG. 13 is a cross-sectional view of the in-line roller skate of FIG. 1 and the fourth embodiment of the brake assembly invention shown in an operational position equivalent to the operational position of FIG. 11.

Description of Fourth Embodiment—FIGS. 12 and 13

The fourth embodiment of the invention is identical to the third embodiment except as subsequently described.

Compare FIGS. 12 and 13 with FIGS. 10 and 11. For clarity, FIG. 12 shows a limited number of parts, primarily parts which are unique to the fourth embodiment. In the fourth embodiment of the invention, brake wheel 188*b*, brake wheel bracket 190*b*, brake wheel axle 192*a*, and lock nut 194*a* replace primary brake pad 178*p* of the third embodiment, and together form a ground-engaging member. Brake wheel 188*b* consists of a central hub containing a bearing 196*b*, and a relatively elastic, resilient tire member 198*b*. Bracket 190*b* consists of cross-member 200*b* and downwardly extending arms 202*b* and 204*b*. Cross-member 200*b* forms an upwardly facing bracket mounting surface 206*b*, which confronts and engages cross-member 172*h*. Bolt 74*p* passes through hole 208*b* in bracket cross-member 200*b*, through housing cross-member aperture 184*h*, and through aperture 186*p* of the secondary brake pad. Nut 80*p* is threadedly received by bolt 74*p*. The lock nut and bolt together clamp bracket 190*b* to cross-member 172*h*, and secondary brake pad 170*p* to cross-member 172*h*.

Holes 210*b* in the bracket arms, and central-axis hole 212*b* in brake wheel bearing 196*b* are aligned on brake wheel axle central-axis 214*a*. Brake wheel axle 192*a* is formed by a bolt having a wide, smoothly contoured head 216*a* and a threaded end 218*a*. The head is preferably provided with a countersunk allen socket 220*a*. The threaded end of the brake wheel axle passes through holes 210*b* and 212*b* along the brake wheel axle central-axis. Lock nut 194*a* is threadedly received on the brake wheel axle. The brake wheel axle and lock nut together rotatably mount the brake wheel to the brake wheel bracket.

Operation of Fourth Embodiment—FIG. 13

Operation of the fourth embodiment is identical to operation of the third embodiment except as subsequently described.

Refer now to FIG. 13. In the forth embodiment of the invention, brake application in the manner of the previous embodiments lowers brake wheel 188*b* into rolling contact with skating surface 148. This results in an upward actuating force on brake wheel 188*b* and brake wheel bracket 190*b*. This force rotates the brake housing counter-clockwise, forwardly displacing roller 82*r* into tire member 26*w* in the manner of the previous embodiments. Roller peripheral surface 72*r* contacts secondary brake pad friction-surface 180*p*. Friction between surfaces 72*r* and 180*p* inhibits roller rotation, thereby inhibiting rotation of skate rear wheel 23*w*. The forward velocity of the skater is reduced by the motion-opposing torque induced on the rear wheel by the secondary brake pad-roller frictional force.

Accordingly, the reader will see that the brake assembly invention is a substantial improvement over prior-art brakes. First consider the advantages provided by all the embodiments presented:

a) The invention is employed such that braking technique is identical to that of current practice. No new braking techniques have to be learned.

b) The invention is easily retrofitable to most currently available in-line roller skates.

c) The invention is employed in a small, space-efficient package which is similar in size to currently available brakes.

d) The tire member acts as a spring which compliantly resists roller displacement and brake housing rotation. This results in brake housing rotations when the brake is applied, thereby providing progressive resistance and a measure of compliance against brake application by the skater. This compliance inhibits braking induced vibrations from being transferred to the skate. This also makes the brake more comfortable to operate, and enhances the ability of the skater to safely apply the brake.

Next consider braking forces, brake pad materials, brake pad wear and brake operation for each embodiment:

1) The first and second embodiments are the simplest, using the same rubber brake pad to contact the skating surface and to contact the roller. Braking forces are substantially greater than those of prior-art skates. Wear on the upper brake surface of the brake pad is moderate since the roller has a smooth surface. Wear on the bottom of the brake pad is reduced since stopping distances are shorter. Brake pad replacement is therefore less frequent than for prior-art brakes.

2) The third embodiment allows different brake materials to be employed against the skating surface and the roller. Traditional brake pad materials can be employed for the secondary brake pad, providing improved wear characteristics for the surface which contacts the roller. The primary and secondary brake pads can be separately replaced, allowing the full wear potential of each pad to be realized. Braking forces may be reduced somewhat as compared with the first and second embodiments, but only if materials with lower coefficients of friction are employed in the secondary brake pad.

3) The fourth embodiment replaces the primary brake pad with a brake wheel. The rolling wheel provides better directional control during braking than the sliding primary brake pad. Braking forces are equivalent to currently available brakes if high friction-coefficient materials are employed in the secondary brake pad.

Although the descriptions above contains many specifities, these do not limit the scope of the invention. The four embodiments presented merely provide illustrations of several possible forms of the invention. Other variations of the invention include but are not limited to: Embodiments which employ different linkage or lever arrangements to support and actuate the roller, brake housing, and any secondary brake pads, embodiments in which brake pads are attached directly to the in-line roller skate, embodiments with a differently-shaped roller, embodiments with differently-shaped axle plugs for wheel-wear compensation, etc.

What is claimed as the invention is:

1. A brake for applying braking forces to an in-line roller skate used on a skating surface through the periphery of one of the skate wheels thereof comprising:

mounting means mounted on the roller skate;

roller means rotatably mounted on said mounting means and adapted to selectively engage the periphery of the skate wheel;

braking means for applying a resistive force to said roller means to retard rotation of said roller means and also the skate wheel when said roller means is in engagement with the skate wheel; and, actuating means for selectively moving said roller means into contact with the periphery of the skate wheel and said braking means into contact with said roller means, said actuating means including ground-engaging means for selectively engaging the skating surface upon tilting of the roller skate to move said roller means into contact with the skate wheel and said braking means into contact with said roller means, thereby causing said braking means to apply said resistive force to said roller means and the rotation of said roller means to be retarded and thus applying a braking force to the skate wheel in opposition to the rotation thereof.

2. The brake of claim 1 wherein said mounting means further includes adjustment means to adjustably locate said mounting means relative to the roller skate wheel periphery thereby maintaining said roller means within a prescribed distance range from the periphery of the skate wheel to compensate for reduced skate wheel diameter caused by wheel wear.

3. The brake of claim 1 wherein said mounting means includes an articulated brake frame assembly to increase the mechanical advantage of the actuating force applied to said roller means by said actuating means.

4. The brake of claim 3 wherein said ground-engaging means comprises a primary brake pad attached to said articulated brake frame assembly and adapted to engage the skating surface to apply a resisting force to the roller skate retarding the movement thereof; and, wherein said braking means includes a secondary brake pad attached to said articulated brake frame assembly and adapted to apply a resisting force to the roller means opposing the rotation thereof so that a braking force is applied to the roller skate wheel through said roller means.

5. The brake of claim 3 wherein said ground-engaging means comprises a brake wheel attached to said articulated brake frame and adapted to engage the skating surface to move said roller means into contact with the skate wheel and cause said braking means to apply said resistive force to said roller means; and, wherein said braking means includes a secondary brake pad attached to said articulated brake frame and adapted to apply a resisting force to the roller means opposing the rotation thereof so that a braking force is applied to the roller skate wheel through said roller means.

6. The brake of claim 3 wherein said articulated brake frame assembly comprises:

a brake frame pivotally connected to said roller skate about the rotational axis of the skate wheel to which the braking forces are to be applied and having a projecting end thereon;

a first linkage assembly having opposed ends, one end of said first linkage assembly pivotally connected to the projecting end of said brake frame about a first linkage axis parallel to the skate wheel rotational axis; and a second linkage assembly having opposed ends, one end of said second linkage pivotally connected to that end of said first linkage assembly opposite that end connected to said brake frame about a roller axis parallel to the skate wheel rotational axis and the opposite end of said second linkage assembly pivotally connected to the roller skate about a second linkage axis spaced from and parallel to the skate wheel rotational axis, said roller means rotatably mounted between said first and second linkage assemblies about said roller axis so that pivoting said brake frame in a first direction about said skate wheel rotational axis forces said roller means into contact with the skate wheel peripheral surface.

7. The brake of claim 6 wherein said braking means is mounted on said brake frame; and wherein said brake frame, said first linkage assembly and second linkage assembly are sized and arranged to move said roller means toward said skate wheel at a rate faster than said braking means is moved toward said roller means to insure non slipping contact between said skate wheel and said roller means as braking force is applied thereto.

8. The brake of claim 4 wherein said primary and secondary brake pads are integral with each other.

9. The brake of claim 2 for mounting on the skate wheel axle wherein said adjustment means comprises:

a pair of cooperating apertures defined in said mounting means; and, a pair of multi-positional axle plugs insertable in said cooperating apertures, said plugs defining eccentrically located holes therethrough for mounting on the skate wheel axle whereby the position of said roller means is incrementally adjusted relative to the roller skate wheel by repositioning said axle plugs within said holes thereby maintaining said roller means within a prescribed distance from the periphery of the skate wheel.

10. A method of braking an in-line roller skate for use on a skating surface, the skate having a plurality of wheels, a roller, braking means, and actuating means which includes ground engaging means, comprising the steps of:

a) tilting the roller skate in a rearward direction to cause the actuating means to force the roller against the periphery of the rearmost roller skate wheel of the roller skate, upon engagement of the ground engaging means with the skating surface, to achieve non-slipping contact between the roller skate wheel and the roller so that the roller skate wheel drivingly rotates the roller; and, b) applying a rotary motion resisting force to the periphery of the roller independently of the roller skate wheel by causing the actuating means to force the braking means into contact with the roller as a result of the rearward tilting of the roller skate, thereby causing the roller to apply a braking force to the roller skate wheel.

* * * * *